US009993023B2

(12) United States Patent
Tucker et al.

(10) Patent No.: US 9,993,023 B2
(45) Date of Patent: Jun. 12, 2018

(54) ELECTRONIC SMOKING ARTICLE

(71) Applicant: Altria Client Services LLC, Richmond, VA (US)

(72) Inventors: Christopher S. Tucker, Midlothian, VA (US); Geoffrey Brandon Jordan, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 627 days.

(21) Appl. No.: 14/185,259

(22) Filed: Feb. 20, 2014

(65) Prior Publication Data

US 2014/0238423 A1 Aug. 28, 2014

Related U.S. Application Data

(60) Provisional application No. 61/768,123, filed on Feb. 22, 2013.

(51) Int. Cl.
*A24F 47/00* (2006.01)

(52) U.S. Cl.
CPC ..... *A24F 47/008* (2013.01)

(58) Field of Classification Search
CPC ..... A24F 47/008
USPC ..... 392/395
See application file for complete search history.

(56) References Cited

U.S. PATENT DOCUMENTS 4,091,264 A * 5/1978 Sarcia ..... F28F 5/02 165/104.26
4,617,232 A 10/1986 Chandler et al.
4,995,547 A * 2/1991 Schubert ..... C04B 37/026 228/124.1
5,018,259 A * 5/1991 Wildman ..... A61C 7/12 216/33
5,595,706 A 1/1997 Sikka et al.
5,649,554 A 7/1997 Sprinkel et al.
5,878,752 A 3/1999 Adams et al.
6,627,116 B1 9/2003 Suda et al.
8,794,231 B2 8/2014 Thorens et al.
2003/0000486 A1 1/2003 Ott et al.
2005/0016549 A1 1/2005 Banerjee et al.
2006/0193981 A1 8/2006 Wheat et al.
2009/0272379 A1 11/2009 Thorens et al.
(Continued)

FOREIGN PATENT DOCUMENTS

CN 1045691 A 10/1990
CN 1205849 A 1/1999
(Continued)

OTHER PUBLICATIONS

International Preliminary Report on Patentability dated Feb. 22, 2013 issued in corresponding PCT Application No. PCT/US2014/017593.

(Continued)

*Primary Examiner* — Eric Yaary
(74) *Attorney, Agent, or Firm* — Harness, Dickey & Pierce, P.L.C.

(57) ABSTRACT

An electronic smoking article includes a liquid supply region including liquid material and a heater-wick element operable to wick liquid material and heat the liquid material to a temperature sufficient to vaporize the liquid material and form an aerosol. The heater-wick element comprises two or more layers of electrically resistive mesh material.

19 Claims, 2 Drawing Sheets

(56) References Cited

U.S. PATENT DOCUMENTS

| | | | | |
|---|---|---|---|---|
| 2009/0308795 | A1* | 12/2009 | Smith | B07B 1/4618 209/399 |
| 2010/0272421 | A1 | 10/2010 | Liu et al. | |
| 2011/0226236 | A1* | 9/2011 | Buchberger | A61M 11/041 128/200.23 |
| 2011/0253798 | A1* | 10/2011 | Tucker | A61L 9/037 239/13 |
| 2012/0024837 | A1 | 2/2012 | Thompson | |
| 2012/0255567 | A1 | 10/2012 | Rose et al. | |
| 2013/0228191 | A1* | 9/2013 | Newton | A24F 47/008 131/329 |
| 2013/0265702 | A1 | 10/2013 | Griffith, Jr. et al. | |
| 2013/0306065 | A1 | 11/2013 | Thorens et al. | |
| 2014/0000638 | A1 | 1/2014 | Sebastian et al. | |
| 2014/0020693 | A1 | 1/2014 | Cochand et al. | |
| 2014/0060555 | A1* | 3/2014 | Chang | A24F 47/008 131/329 |

FOREIGN PATENT DOCUMENTS

| | | | |
|---|---|---|---|
| CN | 1345529 | A | 4/2002 |
| CN | 201379072 | Y | 1/2010 |
| CN | 101878958 | A | 11/2010 |
| CN | 201767029 | U | 3/2011 |
| CN | 201830900 | U | 5/2011 |
| CN | 102264420 | A | 11/2011 |
| CN | 202354377 | U | 8/2012 |
| CN | 202456410 | U | 10/2012 |
| EP | 0358 002 | A2 | 3/1990 |
| EP | 2340729 | A1 | 7/2011 |
| EP | 2460423 | A1 | 6/2012 |
| EP | 2460424 | A1 | 6/2012 |
| EP | 2468117 | A1 | 6/2012 |
| RU | 2009107275 | A | 9/2010 |
| WO | WO-03/034847 | A1 | 5/2003 |

OTHER PUBLICATIONS

International Search Report PCT/ISA/210 for International Application No. PCT/US2014/017593 dated Feb. 22, 2013.
Written Opinion of the International Searching Authority PCT/ISA/237 for International Application No. PCT/US2014/017593 dated Feb. 22, 2013.
Kazakhstan Office Action dated Nov. 7, 2016 issued in corresponding Kazakhstan Application No. 2015/1042.1.
Kazakhstan Office Action dated Nov. 16, 2016 issued in corresponding Kazakhstan Application No. 2015/1044.1.
Chinese Office Action dated Mar. 1, 2017 issued in corresponding Chinese Patent Application No. 21480010167.4 (English translation provided).
Chinese Office Action dated Mar. 8, 2017 issued in corresponding Chinese Patent Application No. 21480010152.8 (English translation provided).
Chinese Office Action dated Mar. 28, 2017 issued in corresponding Chinese Patent Application No. 201480010181.4.
Chinese Office Action dated Mar. 8, 2017 issued in corresponding Chinese Patent Application No. 201480010152.8.
U.S. Office Action dated Jul. 15, 2016 issued in co-pending U.S. Appl. No. 14/185,299.
U.S. Office Action dated May 25, 2016 issued in co-pending U.S. Appl. No. 14/185,230.
U.S. Office Action dated Mar. 22, 2016 issued in co-pending U.S. Appl. No. 14/185,299.
International Search Report PCT/ISA/210 for International Application No. PCT/US2014/017438 dated May 27, 2014.
International Search Report PCT/ISA/210 for International Application No. PCT/US2014/017433 dated May 28, 2014.
European Office Action dated Dec. 5, 2016 issued in corresponding European Patent Application No. 14708441.2.
Chinese Office Action corresponding to Chinese Application No. 201480010152.8 dated Aug. 14, 2017 and English translation thereof.
European Examination Report dated Aug. 7, 2017 for European Application No. EP 14 708 441.2.
Third Party Observation dated May 19, 2017 for European Application No. EP 14 708 441.2.
Office Action for corresponding Russian Application No. 2015140108 dated Oct. 25, 2017 and English translation thereof.
Office Action for corresponding Chinese Application No. 201480010152.8 dated Nov. 16, 2017 and English translation thereof.
Office Action for corresponding Chinese Application No. 201480010187.4 dated Nov. 23, 2017 and English translation thereof.
U.S. Appl. No. 14/185,230, filed Feb. 20, 2014.
U.S. Appl. No. 14/185,299, filed Feb. 20, 2014.
Examination Report for corresponding European Application No. 14709069.0 dated Feb. 27, 2018.
Examination Report for corresponding European Application No. 14708434.7 dated Feb. 27, 2018.
Office Action for corresponding Russian Application No. 2015140077 dated Feb. 16, 2018 and English translation thereof.
Office Action for corresponding Russian Application No. 2015140078 dated Feb. 16, 2018 and English translation thereof.
Ukrainian Office Action for corresponding Ukrainian Application No. a 2015 08992 dated Mar. 3, 2018 and English translation thereof.
European Office Action for corresponding European Application No. 14708441.2 dated Apr. 3, 2018.
Chinese Office Action for corresponding Chinese Application No. 201480010152.8 dated Mar. 21, 2018 and English translation thereof.

* cited by examiner

ELECTRONIC SMOKING ARTICLE

CROSS-REFERENCE TO RELATED APPLICATION

This application claims priority under 35 U.S.C. § 119(e) to U.S. provisional Application No. 61/768,123, filed on Feb. 22, 2013, the entire content of which is incorporated herein by reference thereto.

SUMMARY OF SELECTED FEATURES

An electronic smoking article is provided which includes a heater-wick element which wicks liquid and heats the liquid material to produce an aerosol or "vapor". The heater-wick element preferably comprises at least two layers of an electrically resistive mesh material. The heater-wick element also includes a wicking portion and a heatable portion, which are integrally formed.

DETAILED DESCRIPTION

Figure 1:
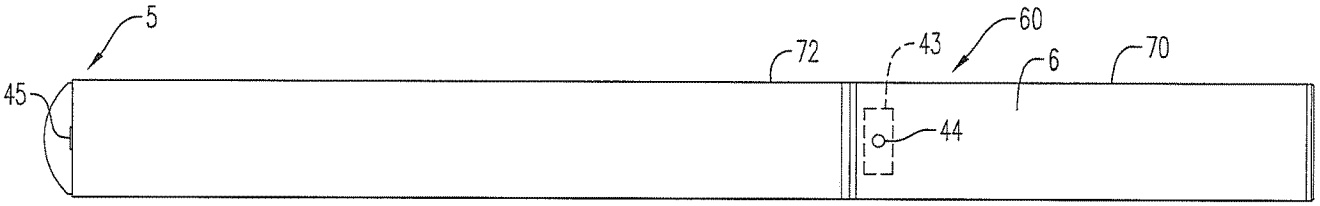
FIG. 1 is a top planar view of an electronic smoking article according to a first embodiment.
Figure 2:
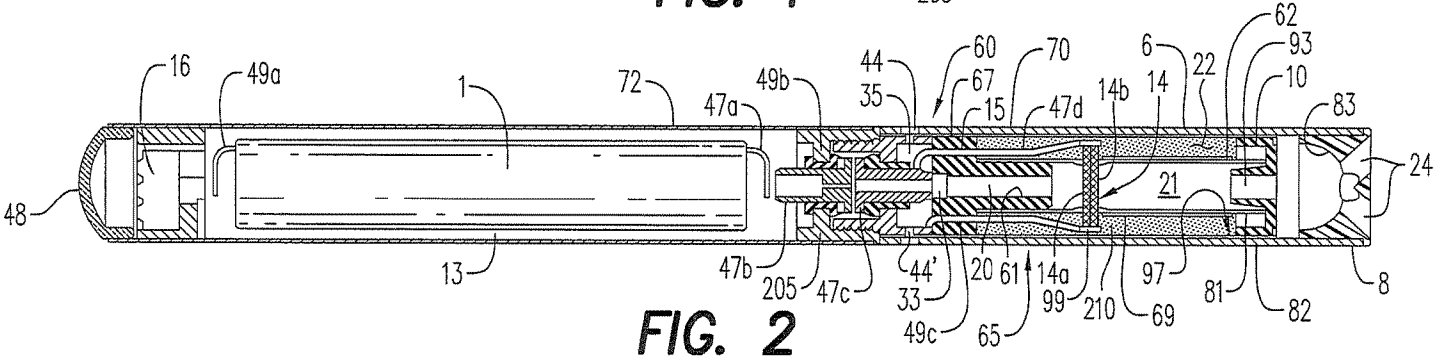
FIG. 2 is a side cross-sectional view of the electronic smoking article shown in FIG. 1 including a heater-wick element including at least two layers of mesh material.

Referring to FIGS. 1 and 2, an electronic smoking article (article) 60 is provided and comprises a replaceable cartridge (or first section) 70 and a reusable fixture (or second section) 72, which in the preferred embodiment are coupled together at a threaded connection 205 or by other convenience such as a snug-fit, detent, clamp and/or clasp. Generally, the second section 72 includes a puff sensor 16 responsive to air drawn into the second section 72 via an air inlet port 45 adjacent the free end or tip of the smoking article 60, a battery 1 and control circuitry. The disposable first section 70 includes a liquid supply region of 22 including liquid and a heater-wick element 14 that wicks liquid from the liquid supply region 22 and heats the liquid to form an aerosol in a central air channel 21. Upon completing the threaded connection 205, the battery 1 is electrically connected with the heater-wick element 14 of the first section 70 upon actuation of the puff sensor. Air is drawn primarily into the first section 70 through one or more air inlets 44.

In the preferred embodiment, once the liquid of the cartridge is spent, only the first section 70 is replaced. An alternate arrangement includes a layout where the entire article 60 is disposed once the liquid supply region is depleted. In such case the battery type and other features might be engineered for simplicity and cost-effectiveness, but generally embodies the same concepts as in the preferred embodiment in which the second section is reused and/or recharged.

In a preferred embodiment, the electronic smoking article 60 is about the same size as a conventional smoking article. In some embodiments, the electronic smoking article 60 can be about 80 mm to about 110 mm long, preferably about 80 mm to about 100 mm long and about 7 mm to about 8 mm in diameter. For example, in a preferred embodiment, the electronic smoking article is about 84 mm long and has a diameter of about 7.8 mm.

Preferably, at least one adhesive-backed label is applied to the outer tube 6. The label completely circumscribes the electronic smoking article 60 and can be colored and/or textured to provide the look and/or feel of a traditional smoking article. The label can include holes therein which are sized and positioned so as to prevent blocking of the air inlets 44.

The first section 70 includes an outer tube (or casing) 6 extending in a longitudinal direction and an inner tube (or chimney) 62 coaxially positioned within the outer tube 6. Preferably, a nose portion 61 of an upstream gasket (or seal) 15 is fitted into an upstream end portion 65 of the inner tube 62, while at the same time, an outer perimeter 67 of the gasket 15 provides a liquid-tight seal with an interior surface of the outer casing 6. The upstream gasket 15 also includes a central, longitudinal air passage 20, which opens into an interior of the inner tube 62 that defines a central channel 21. A transverse channel 33 (shown in FIG. 2) at a backside potion of the gasket 15 intersects and communicates with the central channel 20 of the gasket 15. This channel 33 assures communication between the central channel 20 and a space 35 (see FIG. 2) defined between the gasket 15 and a cathode connector piece 37. In the preferred embodiment, the piece 37 includes a threaded section for effecting the threaded connection 205.

The outer tube 6 and/or the inner tube 62 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, and polyethylene. Preferably, the material is light and non-brittle.

In the preferred embodiment, as shown in FIGS. 1 and 2, the electronic smoking article 60 includes at least one air inlet 44 formed in the outer tube 6, preferably adjacent the threaded connection 205 to minimize the chance of a smoker's fingers occluding one of the inlets and to control the resistance to draw (RTD) during smoking. In the preferred embodiment, the air inlets 44, 44' are sized and configured such that the electronic smoking article 60 has a RTD in the range of from about 60 mm $H_2O$ to about 150 mm $H_2O$, more preferably about 90 mm $H_2O$ to about 110 mm $H_2O$, most preferably about 100 mm $H_2O$ to about 130 mm $H_2O$.

In the preferred embodiment, the second section 72, includes an air inlet 45 at an upstream end 5 of the smoking article 60, which is sized just sufficient to assure proper operation of the puff sensor 16, located nearby. Drawing action upon the mouth end insert 8 is communicated to the air inlet port 45 through central channels provided in the anode post 47*c* of the first section 70 and the anode connection post 47*b* of the second section 72 and along space 13 between the battery 1 and the casing of the second section 72. The air inlet port 45 is sized such that the airflow rate therethrough are much smaller than through the air inlets 44, 44', so that the impact on RTD is minimized and consistency in RTD is maintained. For example, each air inlet can be less than about 2.0 mm in width and less than about 1.5 mm in length. For example, each air inlet can be about 0.7 mm to about 0.8 mm in width and about 0.7 mm to about 0.8 mm in length. In a preferred embodiment, 95% of the air introduced in the smoking article 60 is through the air inlets 44, 44', whereas only 5% of the total air flow enters through the inlet 45 at the upstream end 5 of the smoking article 60.

Preferably, a nose portion 93 of a downstream gasket 10 is fitted into a downstream end portion 81 of the inner tube 62. An outer perimeter 82 of the gasket 10 provides a substantially liquid-tight seal with an interior surface 97 of the outer casing 6. The downstream gasket 10 includes a central channel 84 disposed between the central passage 21 of the inner tube 62 and the interior of the mouth end insert 8 and which communicates aerosol from the central passage 21 to the mouth end insert 8.

The space defined between the gaskets 10 and 15 and the outer tube 6 and the inner tube 62 establish the confines of a liquid supply region 22. The liquid supply region 22 comprises a liquid material and optionally a liquid storage medium operable to store the liquid material therein. The liquid storage medium may comprise a winding of cotton gauze or other fibrous material about the inner tube 62.

In the preferred embodiment, the liquid supply region 22 is contained in an outer annulus between inner tube 62 and outer tube 6 and between the gaskets 10 and 15. Thus, the liquid supply region 22 at least partially surrounds the central air passage 21.

Preferably, the liquid storage medium is a fibrous material comprising cotton, polyethylene, polyester, rayon and combinations thereof. Preferably, the fibers have a diameter ranging in size from about 6 microns to about 15 microns (e.g., about 8 microns to about 12 microns or about 9 microns to about 11 microns). The liquid storage medium can be a sintered, porous, sponge, or foamed material. Also preferably, the fibers are sized to be irrespirable and can have a cross-section which has a y shape, cross shape, clover shape or any other suitable shape. In the alternative, the liquid supply region 22 may comprise a filled tank lacking a fibrous storage medium and containing only liquid material.

Also preferably, the liquid material has a boiling point suitable for use in the electronic smoking article 60. If the boiling point is too high, the heater-wick element 14 will not be able to vaporize the liquid. However, if the boiling point is too low, the liquid may vaporize even when the heater-wick element 14 is not activated.

Preferably, the liquid material includes a tobacco-containing material including volatile tobacco flavor compounds which are released from the liquid upon heating. The liquid may also be a tobacco flavor containing material or a nicotine-containing material. Alternatively, or in addition, the liquid may include a non-tobacco material and/or a nicotine-free material. For example, the liquid may include water, solvents, ethanol, plant extracts and natural or artificial flavors. Preferably, the liquid further includes an aerosol former. Examples of suitable aerosol formers are glycerine and propylene glycol.

In use, liquid material is transferred from the liquid supply region 22 and/or liquid storage medium via the heater-wick element 14, which includes at least one wicking portion 140 and a heatable portion 141. In the preferred embodiment, the heater-wick element 14 includes two wicking portions 140 and a heatable portion 141 therebetween. Also preferably, the wicking portions 140 and the heatable portion 141 are integrally formed and are formed of the same material.

Figure 3:
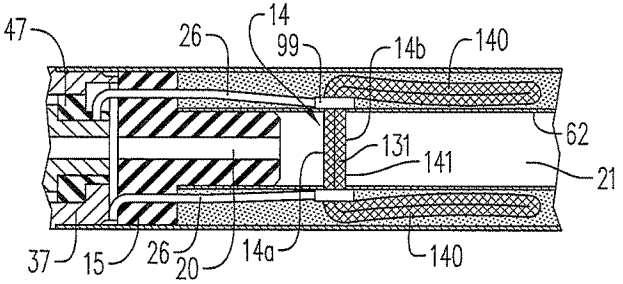
FIG. 3 is an enlarged view of the heater-wick element of FIG. 2.
Figure 4:
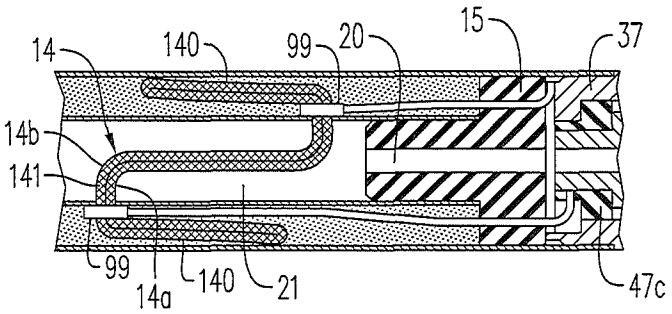
FIG. 4 an enlarged view of a second embodiment of a heater-wick element including at least two layers of mesh material.

As shown in FIGS. 2, 3, and 4, the heater-wick element 14 includes at least two layers of mesh material. The heater-wick element 14 can include three or more, four or more, or five or more layers of mesh material. The layers of mesh material can be connected along a length thereof by brazing, soldering, or other suitable connection means. Preferably, the layers are pressed together, preferably without brazing, soldering or application of adhesive, so as to avoid blocking the interstices of the mesh material.

The heater-wick element 14 is preferably straight, but could be coiled or formed in other geometries. Moreover, the heater-wick element 14 could be inserted in through opposing slots in the inner tube 62. Alternatively, the inner tube 62 can be slit from an edge thereof to a location along the inner tube 62 and the heater-wick element 12 can be slid through the slit and into the desired location along the inner tube 62 such that the heatable portion 141 is in the central channel 21 and each wicking portion 141 extends outside of the inner tube 62.

Figure 6:
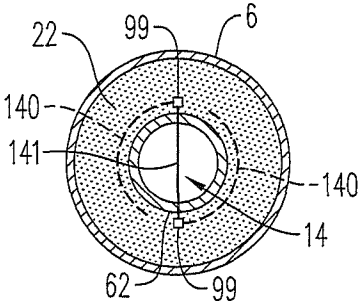
FIG. 6 is a cross-sectional view of the heater-wick element of FIG. 3.

As shown, the heater-wick element 14 extends across the central channel 21 between opposing portions of the liquid supply region 22 and into the liquid supply region 22. Thus, the wicking portion 140 at each end of the heater-wick element 14 extends into the liquid supply region 22 so as to wick liquid into the heatable portion 141 of the heater-wick element 14, which is positioned within the central air passage 21. As shown in FIG. 6, the wicking portions 140 can extend circumferentially about the inner tube 62 within the liquid supply region 22, and in an embodiment, may extend in a spiral about the inner tube 62. Moreover, the heater-wick element 14 includes a first layer of mesh 14*a* and a second layer of mesh material 14*b*.

Since the wicking portions 140 and the heatable portion 141 are both formed of the same material, a single component is used to form the heater-wick element. Thus, advantageously, manufacture of the electronic smoking article 60 is eased because the number of materials and parts is reduced. For example, there is no need to coil a heating element, such as a heater wire, about a wicking material.

Preferably, the heater-wick element 14 includes multiple layers of a mesh material (e.g., at least two layers, at least three layers, at least four layers or more). Examples of suitable electrically resistive materials include titanium, zirconium, tantalum and metals from the platinum group. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese- and iron-containing alloys, and super-alloys based on nickel, iron, cobalt, stainless steel. For example, the heater-wick element 14 can be formed of nickel aluminides, a material with a layer of alumina on the surface, iron aluminides and other composite materials, the electrically resistive material may optionally be embedded in, encapsulated or coated with an insulating material or vice-versa, depending on the kinetics of energy transfer and the external physicochemical properties required. Preferably, the heater-wick element 14 comprises at least one material selected from the group consisting of stainless steel, copper, copper alloys, nickel-chromium alloys, superalloys and combinations thereof. In a preferred embodiment, the heater-wick element 14 is formed of nickel-chromium alloys or iron-chromium alloys.

In another embodiment, the heater-wick element 14 may be constructed of an iron-aluminide (e.g., FeAl or $Fe_3Al$), such as those described in commonly owned U.S. Pat. No. 5,595,706 to Sikka et al. filed Dec. 29, 1994, or nickel aluminides (e.g., $Ni_3Al$). Use of iron-aluminides is particularly advantageous in that they exhibit high resistivity. FeAl exhibits a resistivity of approximately 180 micro-ohms, whereas stainless steel exhibits approximately 50 to 91 micro-ohms. The higher resistivity lowers current draw or load on the power source (battery) 1.

Preferably, as shown in FIGS. 2, 3, 4 and 5, a conductive connection region (e.g., a post) 99 formed of a low-resistance material is preferably brazed to each end or at two locations along a portion of the of the heater-wick element 14. Preferably, the brazed connection regions 99 are formed just inside of the inner tube 62 and the heatable portion 141 extends between the brazed connections regions 99. In another embodiment, the brazed connection regions 99 are contained entirely in the outer annulus as shown in FIGS. 3 and 4. By forming the brazed connection regions 99, the electrical current is uniform across the length and width of each layer of the mesh heater-wick element 14 so as to avoid hot spots.

Figure 5:
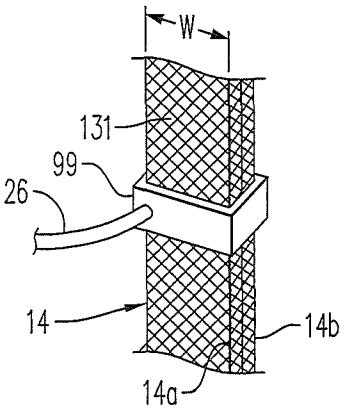
FIG. 5 is an enlarged view of an electrical connection with a heater-wick element.

For example, the conductive connection region 99 can be formed by wrapping a gold-plated wire around the layers of mesh material and brazing the wire to the mesh at selected locations so as to form a heatable portion 141 between the brazed connection regions 99. Electrical leads 26 are attached to each brazed connection region 99 (or post), as shown in FIG. 5, such that, when voltage is applied by the power supply, the heatable portion 141 heats the liquid material in the heatable portion 141 to a temperature sufficient to at least partially volatilize the liquid and form an aerosol. Alternatively, the electrical leads 26 can be attached directly to the mesh heater-wick element 14.

In the preferred embodiment, the mesh material heater-wick element 14 is formed of a thermally and/or electrically conductive material. Suitable materials for forming the mesh material are selected from the group consisting of stainless steel, copper, copper alloys, Inconel® available from Special Metals Corporation, which is a nickel-chromium alloy, Nichrome®, which is also a nickel-chromium alloy, and combinations thereof.

In a preferred embodiment, the heater-Wick element 14 is constructed from wire mesh filaments having a width in the range of about 0.5 mm to about 2 mm, preferably about 1 mm, and a length in the range of about 20 mm to about 40 mm. The heater-wick element 14 has a length in the range of about 10 mm to about 15 mm, preferably about 12 mm or less, and a width in the range of about 0.5 mm to about 2.0 mm, preferably about 1.5 mm or less. At about 1.5 mm width, the heater-wick element 14 is preferably oriented longitudinally within the electronic smoking article whereas heater-wick assemblies having a smaller width may be placed in a transverse direction within the electronic smoking article.

In the preferred embodiment, the mesh material can range in size from about 200 mesh to about 600 mesh. In the preferred embodiment, the mesh material is about 400 mesh and includes small voids/interstices 131 between the wires that form the mesh material and between the two or more layers of the heater-wick element 14. Preferably, the mesh material is formed with 0.001 inch or greater diameter wire, such as wire available from Smallparts, Inc. Also preferably, the wire comprising the mesh is a solid wire of about 0.0014 inch to about 0.0016 inch diameter.

In the preferred embodiment, the mesh material of the heater-wick element 14 has a criss-cross, checkerboard type pattern with interstices 131 (shown in FIG. 5) therein. Preferably, each layer of the heater-wick element 14 comprises a single, elongate, flat layer of mesh material. Also preferably, each layer of the mesh material achieves an electrical resistance ranging from about 0.3 Ohm to about 10 Ohms, more preferably about 0.8 Ohm to about 5.0 Ohms, more preferably about 4.0 Ohms or less.

In addition, liquid can be drawn into the interstices 131 of the mesh material and between the layers of mesh material in the heater-wick element 14 during a power cycle of the electronic smoking article. Thus, the liquid moves along the heater-wick element from the wicking portions 140 to the heatable portion 141.

Advantageously, the mesh material provides a workable range of resistivity for applications such as in electronic smoking articles. In addition, the use of a mesh heater-wick element 14 including multiple layers of mesh material allows for the formation of an electronic smoking article having a single part that acts as both a heater and a wick instead of requiring additional components. Moreover, by layering the mesh material, capillary action of the mesh material is increased so as to provide constant aerosol when heated because the mesh continually refills itself. The increase in capillary action is a result of additional interstices within the mesh and between the different layers of mesh material.

Advantageously, the liquid material in the liquid supply region 22 is protected from oxygen (because oxygen cannot generally enter the liquid supply region 22 via the heater-wick element 14). In some embodiments, the liquid material is also protected from light so that the risk of degradation of the liquid material is significantly reduced. Thus, a high level of shelf-life and cleanliness can be maintained.

In the preferred embodiment, the liquid supply region 22 is sized and configured to hold enough liquid material such that the electronic smoking article 60 is operable for smoking for at least about 200 seconds, preferably at least about 250 seconds, more preferably at least 300 seconds and most preferably at least about 350 seconds. Thus, liquid supply region 22 is equivalent to about one pack of traditional smoking articles. Moreover, the electronic smoking article 60 can be configured to allow each puff to last a maximum of about 5 seconds.

As shown in FIGS. 2 and 4, the first section 70 can include a mouth end insert 8 having at least two diverging outlets 24 (e.g., 3, 4, 5 or more, preferably 2 to 10 outlets or more, more preferably 6 to 8 outlets, even more preferably 2 to 6 outlets or 4 outlets). Preferably, the outlets 24 are located off-axis and are angled outwardly in relation to the central channel 21 of the inner tube 62 (i.e., divergently). Also preferably, the mouth end insert (or flow guide) 8 includes outlets 24 uniformly distributed about the perimeter of mouth end insert 8 so as to substantially uniformly distribute aerosol in a smoker's mouth during use and create a greater perception of fullness in the mouth. Thus, as the aerosol passes into a smoker's mouth, the aerosol enters the mouth and moves in different directions so as to provide a full mouth feel. In contrast, electronic smoking articles having a single, on-axis orifice tend to direct its aerosol as single jet of greater velocity toward a more limited location within a smoker's mouth.

In addition, the diverging outlets 24 are arranged and include interior surfaces 83 such that droplets of unaerosolized liquid material, if any, that may be entrained in the aerosol impact the interior surfaces 83 of the mouth end insert 8 and/or impact portions of walls 305 which define the diverging outlets 24. As a result such droplets are substantially removed or broken apart, to the enhancement of the aerosol.

In the preferred embodiment, the diverging outlets 24 are angled at about 5° to about 60° with respect to the longitudinal axis of the outer tube 6 so as to more completely distribute aerosol throughout a mouth of a smoker during use and to remove droplets. In a preferred embodiment, there are four diverging outlets 24 each at an angle of about 40° to about 50° with respect to the longitudinal axis of the outer tube 6, more preferably about 40° to about 45° and most preferably about 42°.

Preferably, each of the diverging outlets 24 has a diameter ranging from about 0.015 inch to about 0.090 inch (e.g., about 0.020 inch to about 0.040 inch or about 0.028 inch to about 0.038 inch). The size of the diverging outlets 24 and the number of diverging outlets 24 can be selected to adjust the resistance to draw (RTD) of the electronic smoking article 60, if desired.

The mouth end insert 8 may be integrally affixed within the tube 6 of the cartridge 70. Moreover, the mouth end insert 8 can be formed of a polymer selected from the group consisting of low density polyethylene, high density polyethylene, polypropylene, polyvinylchloride, polyetheretherketone (PEEK) and combinations thereof. The mouth end insert 8 may also be colored if desired.

In the preferred embodiment, the power supply 1 includes a battery arranged in the electronic smoking article 60 such that the anode 47*a* is downstream of the cathode 49*a*. A battery anode post 47*b* of the second section 72 preferably contacts the battery anode 47*a*.

More specifically, electrical connection between the anode 47*a* of the battery 1 and the heater-wick element 14 in the first section 70 is established through a battery anode connection post 47*b* in the second section 72 of the electronic smoking article 60, an anode post 47*c* of the cartridge 70 and an electrical lead 47*d* connecting a rim portion of the anode post 47*c* with the heater-wick element 14. Likewise, electrical connection between the cathode 49*a* of the battery 1 and the other lead of the heater-wick element 14 is established through the threaded connection 205 between a cathode connection fixture 49*b* of the second portion 72 and the cathode connector piece 37 of the first section 70 and from there through an electrical lead 49*c* which electrically connects the fixture 37 to the opposite lead of the heater-wick element 14.

The battery can be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, preferably, the electronic smoking article 60 is usable by a smoker until the energy in the power supply is depleted or in the case of lithium polymer battery, a minimum voltage cut-off level is achieved.

Alternatively, the power supply 1 may be rechargeable and include circuitry allowing the battery to be chargeable by an external charging device. In that case, preferably the circuitry, when charged, provides power for a pre-determined number of puffs, after which the circuitry must be re-connected to an external charging device. To recharge the electronic smoking article 60, an USB charger or other suitable charger assembly can be used.

Preferably, the electronic smoking article 60 also includes control circuitry including a puff sensor 16. The puff sensor 16 is operable to sense an air pressure drop and initiate application of voltage from the power supply 1 to the heater-wick element 14. As shown in FIG. 2, the control circuitry can also include a heater activation light 48 operable to glow when the heatable portion 141 of the heater-wick element 14 is activated. Preferably, the heater activation light 48 comprises an LED and is at an upstream end of the electronic smoking article 60 so that the heater activation light 48 takes on the appearance of a burning coal during a puff. Moreover, the heater activation light 48 can be arranged to be visible to the smoker. In addition, the heater activation light 48 can be utilized for smoking article system diagnostics or to indicate that recharging is in progress. The light 48 can also be configured such that the smoker can activate and/or deactivate the light 48 for privacy, such that the light 48 would not activate during smoking if desired.

Preferably, the at least one air inlet 45 (FIG. 1) is located adjacent the puff sensor 16, such that the puff sensor 16 senses air flow indicative of a smoker taking a puff and activates the power supply 1 and the heater activation light 48 to indicate that the heatable portion 141 of the heater-wick element 14 is working.

A control circuit is preferably integrated with the puff sensor 16 and supplies power to the heater-wick element 14 responsive to the puff sensor 16, preferably with a maximum, time-period limiter.

Alternatively, the control circuitry may include a manually operable switch for a smoker to initiate a puff. The time-period of the electric current supply to the heater-wick element may be pre-set depending on the amount of liquid desired to be vaporized. Alternatively, the circuitry may supply power to the heater-wick element 14 as long as the puff sensor 16 detects a pressure drop.

Preferably, when activated, the heater-wick element 14 heats and volatilizes liquid in contact with the heater-wick element 14 for less than about 10 seconds, more preferably less than about 7 seconds. Thus, the power cycle (or maximum puff length) can range in period from about 2 seconds to about 10 seconds (e.g., about 3 seconds to about 9 seconds, about 4 seconds to about 8 seconds or about 5 seconds to about 7 seconds).

Preferably, the heater-wick element 14 heats liquid by thermal conduction. Alternatively, heat from the heater-wick element 14 may be conducted to the liquid by means of a heat conductive element or the heater-wick element 14 may transfer heat to the incoming ambient air that is drawn through the electronic smoking article 60 during use, which in turn heats the liquid by convection.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and non-obvious electronic smoking article has been described in this specification with sufficient particularity as to be understood by one of ordinary skill in the art. Moreover, it will be apparent to those skilled in the art that numerous modifications, variations, substitutions, and equivalents exist for features of the electronic smoking article which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

We claim:

1. An electronic vaping device comprising:

a liquid supply region including a liquid material;

an integral heater-wick element in fluidic communication with the liquid supply region, the integral heater-wick element including a heatable portion and at least one wicking portion formed of at least two layers of electrically resistive mesh material, the at least one wicking portion extending into the liquid supply region;

at least one connection structure wrapped around the integral heater-wick element; and at least one electrical lead connected to the at least one connection structure.

2. The electronic vaping device of claim 1, wherein the electrically resistive mesh material comprises at least one of stainless steel, copper, copper alloys, ceramic materials coated with film resistive material, nickel-chromium alloys, and combinations thereof.

3. The electronic vaping device of claim 1, wherein the electrically resistive mesh material is about 200 to about 600 mesh.

4. The electronic vaping device of claim 3, wherein the electrically resistive mesh material is about 400 mesh.

5. The electronic vaping device of claim 1, wherein the electrically resistive mesh material is formed with 0.001 inch diameter wire.

6. The electronic vaping device of claim 1, wherein the integral heater-wick element has a length ranging from about 10 mm to about 15 mm and a width ranging from about 0.5 mm to about 2.0 mm.

7. The electronic vaping device of claim 1, wherein each layer of the electrically resistive mesh material is elongated and planar.

8. The electronic vaping device of claim 1, wherein the at least two layers of electrically resistive mesh material are connected along a length thereof.

9. The electronic vaping device of claim 1, wherein the heatable portion is contained within a central air channel.

10. The electronic vaping device of claim 1, wherein the at least two layers of electrically resistive mesh material are three or more layers of the electrically resistive mesh material.

11. The electronic vaping device of claim 1, wherein the electrically resistive mesh material has an electrical resistance ranging from about 0.3 Ohm to about 10 Ohms.

12. The electronic vaping device of claim 1, wherein the electrically resistive mesh material is formed with wire having a diameter of greater than about 0.001 inch.

13. A method of improving vaporization in an electronic vaping device, the method comprising:

transferring a liquid material from a liquid supply region to a channel using an integral heater-wick element including a heatable portion and at least one wicking portion formed of at least two layers of electrically resistive mesh material, the at least one wicking portion extending into the liquid supply region; and directing an electrical current through the heatable portion via at least one electrical lead connected to at least one connection structure wrapped around the integral heater-wick element to at least partially volatilize the liquid material.

14. The method of claim 13, wherein the transferring transfers the liquid material to the channel via only the wicking portion of the integral heater-wick element.

15. The electronic vaping device of claim 1, wherein only the wicking portion of the integral heater-wick element extends into the liquid supply region.

16. The electronic vaping device of claim 1, wherein the at least one connection structure includes a first connection structure and a second connection structure, the heatable portion of the integral heater-wick element being between the first connection structure and the second connection structure.

17. The electronic vaping device of claim 1, further comprising:

an outer tube; and an inner tube defining a central air channel, wherein the outer tube and the inner tube define an annulus in between, the at least one connection structure disposed in the annulus.

18. The electronic vaping device of claim 1, wherein the at least one connection structure is in the liquid supply region.

19. The electronic vaping device of claim 1, wherein the at least one electrical lead is in the liquid supply region.

* * * * *